US009458390B2

(12) United States Patent
Keusenkothen

(10) Patent No.: US 9,458,390 B2
(45) Date of Patent: Oct. 4, 2016

(54) PROCESS AND SYSTEM FOR PREPARATION OF HYDROCARBON FEEDSTOCKS FOR CATALYTIC CRACKING

(75) Inventor: Paul F. Keusenkothen, Houston, TX (US)

(73) Assignee: ExxonMobil Chemical Patents Inc., Baytown, TX (US)

( * ) Notice: Subject to any disclaimer, the term of this patent is extended or adjusted under 35 U.S.C. 154(b) by 964 days.

(21) Appl. No.: 12/496,037

(22) Filed: Jul. 1, 2009

(65) Prior Publication Data

US 2011/0000819 A1 Jan. 6, 2011

(51) Int. Cl.

| | |
|---|---|
| ***C10G 9/00*** | (2006.01) |
| ***C10G 11/00*** | (2006.01) |
| ***C10G 55/06*** | (2006.01) |
| ***C10G 69/04*** | (2006.01) |

(52) U.S. Cl.

CPC ..... *C10G 11/00* (2013.01); *C10G 55/06* (2013.01); *C10G 69/04* (2013.01); *C10G 2300/107* (2013.01); *C10G 2300/1077* (2013.01); *C10G 2300/205* (2013.01); *C10G 2300/301* (2013.01); *C10G 2400/20* (2013.01)

(58) Field of Classification Search

USPC ..... 208/85, 89, 106, 113, 118, 120.01, 130, 208/92; 585/648, 650, 653, 921, 923

See application file for complete search history.

(56) References Cited

U.S. PATENT DOCUMENTS

| | | | | |
|---|---|---|---|---|
| 2,695,264 | A * | 11/1954 | Taff et al. | 208/88 |
| 2,915,457 | A | 12/1959 | Abbott et al. | |
| 2,963,423 | A * | 12/1960 | Birchfield | 208/251 R |
| 3,168,461 | A * | 2/1965 | Russell et al. | 208/89 |
| 3,855,113 | A | 12/1974 | Gould | |
| 4,057,490 | A | 11/1977 | Wynne, Jr. | |
| 4,179,355 | A | 12/1979 | Frayer et al. | |
| 4,257,871 | A | 3/1981 | Wernicke et al. | |
| 4,297,204 | A | 10/1981 | Schliebener et al. | |
| 4,992,163 | A | 2/1991 | Aldridge et al. | |
| 5,009,768 | A | 4/1991 | Galiasso et al. | |
| 5,919,352 | A | 7/1999 | Serrand et al. | |
| 6,087,662 | A * | 7/2000 | Wilt | G01N 33/2823 250/339.09 |
| 6,190,533 | B1 | 2/2001 | Bradow et al. | |
| 6,210,562 | B1 | 4/2001 | Xie et al. | |
| 6,303,842 | B1 | 10/2001 | Bridges et al. | |

(Continued)

FOREIGN PATENT DOCUMENTS

| | | |
|---|---|---|
| GB | 2 071 133 | 9/1981 |
| JP | 57-212294 | 6/1981 |

(Continued)

OTHER PUBLICATIONS

Speight, James, "Refinery Processes" in Kirk-Othmer Encyclopedia of Chemical Technology, McGraw-Hill, 1996—month unknown.*

(Continued)

*Primary Examiner* — In Suk Bullock
*Assistant Examiner* — Youngsul Jeong

(57) ABSTRACT

A process, apparatus and system for forming light olefins, the process including heating a resid-containing hydrocarbon feedstock containing at least 10 ppmw of metals to vaporize at least 90 wt. % of said hydrocarbon feedstock; separating in a knockout drum a hydrocarbon vapor portion having less than 10 ppmw metals from a non-vaporized resid-containing portion; and feeding said hydrocarbon vapor to a catalytic cracking process to form light olefins.

11 Claims, 1 Drawing Sheet

(56) References Cited

U.S. PATENT DOCUMENTS

| | | | | |
|---|---|---|---|---|
| 6,420,621 | B2 | 7/2002 | Sha et al. | |
| 6,632,351 | B1 | 10/2003 | Ngan et al. | |
| 6,743,961 | B2 | 6/2004 | Powers | |
| 7,090,765 | B2 | 8/2006 | Spicer et al. | |
| 7,097,758 | B2 | 8/2006 | Stell et al. | |
| 7,138,047 | B2 | 11/2006 | Stell et al. | |
| 7,193,123 | B2 | 3/2007 | Stell et al. | |
| 7,220,887 | B2 | 5/2007 | Stell et al. | |
| 7,235,705 | B2 | 6/2007 | Stell | |
| 7,244,871 | B2 | 7/2007 | Stell et al. | |
| 7,247,765 | B2 | 7/2007 | Stell et al. | |
| 7,285,697 | B2 | 10/2007 | Keusenkothen | |
| 7,297,833 | B2 | 11/2007 | Beattie et al. | |
| 7,311,746 | B2 | 12/2007 | Stell et al. | |
| 7,312,371 | B2 | 12/2007 | Stell et al. | |
| 7,326,332 | B2 | 2/2008 | Chen et al. | |
| 7,351,872 | B2 | 4/2008 | Stell et al. | |
| 7,358,413 | B2 | 4/2008 | Stell et al. | |
| 7,402,237 | B2 | 7/2008 | McCoy et al. | |
| 7,408,093 | B2 | 8/2008 | Stell et al. | |
| 7,481,871 | B2 | 1/2009 | Frye et al. | |
| 7,488,459 | B2 | 2/2009 | Stell et al. | |
| 7,615,143 | B2 | 11/2009 | Chen et al. | |
| 7,718,049 | B2 | 5/2010 | Strack et al. | |
| 7,820,035 | B2 | 10/2010 | McCoy et al. | |
| 2003/0173254 | A1 | 9/2003 | Chen et al. | |
| 2005/0261530 | A1 | 11/2005 | Stell et al. | |
| 2006/0089519 | A1* | 4/2006 | Stell et al. | 585/648 |
| 2007/0066860 | A1 | 3/2007 | Buchanan et al. | |
| 2007/0090018 | A1 | 4/2007 | Keusenkothen et al. | |
| 2007/0090019 | A1 | 4/2007 | Keusenkothen et al. | |
| 2007/0090020 | A1 | 4/2007 | Buchanan et al. | |
| 2007/0160513 | A1* | 7/2007 | Stell et al. | 422/194 |
| 2008/0300438 | A1 | 12/2008 | Keusenkothen et al. | |
| 2008/0314729 | A1 | 12/2008 | Sideropoulos et al. | |
| 2010/0130803 | A1 | 5/2010 | Keusenkothen et al. | |

FOREIGN PATENT DOCUMENTS

| | | |
|---|---|---|
| JP | 58-5393 | 7/1981 |
| JP | 58-98387 | 12/1981 |

OTHER PUBLICATIONS

English Abstract for JP 57-212294.
English Abstract for JP 58-5393.
English Abstract for JP 58-98387.
Erdoel & Kohle, Erdgas, Petrochemie, 1981, 34(1), pp. 443-446.

* cited by examiner

PROCESS AND SYSTEM FOR PREPARATION OF HYDROCARBON FEEDSTOCKS FOR CATALYTIC CRACKING

FIELD OF THE INVENTION

This invention relates to a method and apparatus for removing metals and other nonvolatile resid fractions from liquid hydrocarbon feedstock to prepare such feed for use in catalytic cracking processes.

BACKGROUND

Catalytic pyrolysis process (CPP) is a petrochemical process used for cracking a liquid hydrocarbon feed that utilizes both heat and catalytic action to crack the feed and generate light olefins and aromatics. Light olefins include unsaturated aliphatic hydrocarbons generally having, for example, two to eight carbon atoms and including one or more double bonds, with preference often given toward generation of ethylene, propylene, butylenes, butadiene, and aromatics such as benzene, toluene, and xylenes. CPP process and CPP reactors are somewhat analogous to fluidized catalytic cracking (FCC) processes and reactors, except CPP utilizes steam as a diluent, similar to steam cracking, and commonly CPP reactors operate at higher temperatures (e.g., +150° C.) than FCC reactors. Feeds for CPP and FCC processes (collectively, "catalytic cracking processes") are preferably substantially free (e.g., <5 ppmw) of metals and other non-volatile components to avoid deactivation or contamination of the catalyst. High concentrations of metallic contaminants in a feed to a cat cracking process (e.g., >10 ppmw) leads to rapid catalyst fouling or contamination. The metallic contaminants tend to deposit and plug the pores or otherwise deactivate catalyst in a catalytic cracking reactor. The metals may be in the form of metal compounds, and/or organo-metallic compounds such as metal-containing porphyrins or porphyrin-like complexes.

Many liquid hydrocarbon feeds, such as naphthas, are substantially free of such contaminants or contain only an acceptably small portion and are thus suitable as cat cracking feed. Other feeds require more preliminary processing and preparation for generation of a suitable cat cracking feed stream. In some feed preparation processes, the liquid feed may be preliminarily processed, such as via desalting by water wash, but otherwise has substantially no non-volatile content. More contaminated feeds however, may be subjected to more substantial and costly processing to remove selected suitable fractions therefrom, such as via distillation, whereby the feed is fractionated into various cuts, such as gasoline, kerosene, naphtha, gas-oil (vacuum or atmospheric) and the like, which may be fed to a cat cracking process. Undesirable non-volatile components may be removed therefrom, including a higher boiling point bottoms component commonly referred to as residuum ("resid"), having for example, final boiling point of greater than 650° F. (343° C.), at atmospheric pressure. Commonly, the resid fractions remaining in the bottoms of the towers are not used for catalytic cracking feed and are typically disposed to low value uses. Multi-step separation processes such as distillation or fractionation typically require use of costly towers, refinery equipment, valuable storage space, and related processes, and typically only a limited portion of the original feed, if any, may be used as cat cracking feed. The higher costs associated with such expensive preliminary processes typically precludes so treating economically advantageous, lower cost feeds. Often use of feeds from treated refinery feed sources (e.g., such as feed for fluidized catalytic cracking processes, FCC, as used in gasoline manufacture) are more costly and useful for higher value processes than as cat cracking feed.

Patents are known to have addressed some aspects of the above-mentioned challenges posed with treating metal-laden liquid hydrocarbon feedstocks, but need for further improved processes remains. For example:

U.S. Pat. No. 4,257,871, incorporated herein by reference in its entirety, discloses using vacuum residue for production of olefins by first separating, preferably by solvent extraction, the asphalt therein, blending resultant asphalt-depleted fraction with a lighter fraction, e.g., a vacuum gas oil, and then subjecting the blend to a conventional catalytic hydrogenation step prior to thermal cracking. The hydrogenate may be separated into fractions with the heavy fraction only being thermally cracked.

U.S. Pat. No. 4,992,163, incorporated herein by reference in its entirety, discloses a method of reducing the concentration of metal contaminants, such as vanadium and nickel, in distillates of a fossil fuel feedstock, comprising producing a selected distillate fraction and demetallizing the distillate by, for example hydroprocessing, precipitation or deasphalting, thereby upgrading and making it suitable for use as feed to a catalytic cracker.

U.S. Pat. No. 5,009,768, incorporated herein by reference in its entirety, discloses a hydrocatalytic process for treating vacuum gas oils, residual feedstocks or mixtures thereof in the presence of up to 100 ppm of V and Ni at moderate hydrogen partial pressures. The process consists of two or more stages: (a) demetallization of feedstock to levels below 10 ppm of V and Ni, and (b) hydrodenitrogenation and hydroconversion of catalysts using a combined bed, and catalytic cracking of the 370° C.+/− fraction to obtain gasolines.

Despite the above advances, the art needs a simplified, more economical process that can treat a wider range of hydrocarbon feedstocks, particularly cost advantaged, metal contaminated feeds, and convert a high weight percentage of such feed to a vaporizable feedstock useful as feed for catalytic cracking processes. It is also desirable to have a simplified process and apparatus that utilizes a single vessel that can adequately feed a catalytic cracking complex, such as but not limited to a PCC or FCC complex having multiple crackers.

SUMMARY

In one aspect, the present invention provides a process for treating a metals contaminated liquid hydrocarbon feed stream in a simple vaporization and/or separation process to provide a large cut of the feedstock (e.g., at least 90 wt. % or at least 95 wt. %, or even at least 98 wt. % feedstock suitable) to a catalytic cracking process, preferably in some embodiments to a CPP process. Heavier liquid hydrocarbon feed streams, particularly those feed streams having a substantial quantity of metals (e.g., at least 10 ppmw), ash, and/or nonvolatile components are less costly (more "advantaged") than the cleaner, higher value feed streams and are thus more desirable for use as a cat cracking, FCC, or CPP feed stream. Exemplary advantaged feeds may include but are not limited to atmospheric and vacuum distillation bottoms or resid streams, other "resid" streams, metal contaminated hydrocarbon streams, whole crude streams, distressed or contaminated gas-oil streams, virgin crude, asphaltene- and/or tar-laden streams, and mixtures thereof (collectively, "resids" or "resid streams"). Such streams include fractions having a final boiling point in excess of 650° F. (343° C.) and/or a metals content of at least 10 ppmw. Correspondingly, it is desirable to have catalytic cracking processes that can advantageously utilize these heavier and/or otherwise "advantaged" hydrocarbon feeds and can produce light olefins more efficiently than existing catalytic cracking feeds, processes, and apparatus.

In one embodiment, the invention includes a process for forming light olefins, comprising: (a) heating a hydrocarbon feedstock containing at least 10 ppmw of metals to vaporize at least 90 wt. % of the hydrocarbon feedstock; (b) separating in a knockout drum a hydrocarbon vapor portion having less than 10 ppmw metals from a non-vaporized resid-containing portion; and (c) feeding the hydrocarbon vapor to a catalytic cracking process to form light olefins.

In one embodiment, the separated vapor portion includes less than or not greater than 5 ppmw of metals. Metal content in the hydrocarbon may be determined such as by ASTM D-5863, "Standard Test Methods for Determination of Nickel, Vanadium, Iron, and Sodium in Crude Oils, and Residuals Fuels by Atomic Absorption Spectrometry."

In other aspects, the process may further comprise heating the resid-containing hydrocarbon feedstock in an indirect heat exchanger and feeding a heated resid-containing hydrocarbon feedstock to the knockout drum.

In another embodiment, the process further comprises heating the knockout drum internally with at least one of an immersion heater, introduction into the drum of steam, and introduction into the drum of a heated gas, and combinations thereof.

In other embodiments, the process may further comprise hydroprocessing the hydrocarbon feed upstream of the knockout drum.

In other embodiments, the process further comprises visbreaking the hydrocarbon feed upstream of the knockout drum.

DETAILED DESCRIPTION OF THE EMBODIMENTS

A variety of catalytic cracking processes are known for converting heavier hydrocarbons into lighter olefinic hydrocarbons, including catalytic pyrolysis processes, fluidized catalytic cracking processes, high severity fluidized catalytic cracking processes and deep catalytic cracking processes, any of which can find use in combination with the present invention.

As discussed above, some of the catalysts used in the various catalytic cracking processes are subject to deactivation by typical contaminants in refinery feedstocks, particularly by naturally occurring metals (including inorganic salts) in the feedstocks. The process disclosed in U.S. Pat. No. 6,420,621, incorporated herein by reference in its entirety, also known as the catalytic pyrolysis process (CPP), is particularly sensitive to metals content in the feedstocks therefor. This process is usable for individual pyrolysis or co-feed pyrolysis of hydrocarbons from refinery gases, liquid hydrocarbons, to heavy residues. The catalytic pyrolysis process (CPP) is much more effective with low metal-containing (<5 ppm) feedstocks.

Crude or resid-containing fractions thereof, particularly atmospheric resid, vacuum resid, or any asphaltene-containing refinery or chemical intermediate stream may be a preferred feed to the inventive process. When the feed comprises greater than 0.1 wt. % or preferably greater than 5.0 wt. % asphaltenes, a knockout drum or vapor/liquid separator is advantageously used to remove at least a portion of the asphaltenes prior to entering the catalytic cracker unit. Preferred feeds include a hydrocarbon stream having a high concentration of metals, such as vanadium and/or nickel at concentrations of at least 10 ppmw, even at least 100 ppmw, or even at least 200 ppmw, polycyclic aromatics, particularly those high in heterocyclic rings, tar, and topped crude. "Topped crude" may be defined as the cut roughly having a boiling point of from 500-600° F. (260-315° C.) and higher cut, but below temperatures where significant cracking occurs, e.g., 650° F.-700° F. (340-370° C.); often topped crude is used as a synonym for atmospheric resid. This preferred feed may or may not contain appreciable amounts of resid.

Figure 1:
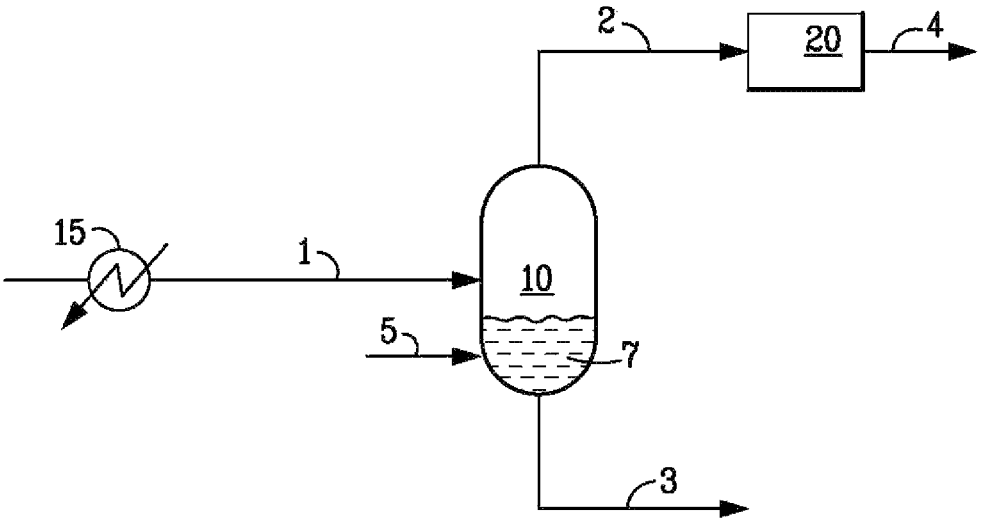
FIG. 1 is an illustration of a system for conducting one embodiment of the invention.

Some preferred embodiments of the present invention will be described below in conjunction with the accompanying FIGS. 1 and 2. However, alternative embodiments are possible without departing from the present invention. Like-numbered items in the figures represent like apparatuses.

In efforts to improve efficiencies and lower refining costs, the present invention is directed to a process wherein (FIG. 1) resid-containing hydrocarbon feeds 1 such as crude, atmospheric resid, and dirty heavy feeds (i.e., "advantaged feeds") can be pretreated without distillation to remove metals therefrom, prior to the aforementioned catalytic cracking processes, in either a knockout drum 10, also known as a flash separator (not shown), wherein vaporized hydrocarbons are separated from a resid-containing liquid phase (7) enriched in metal content by the process. The resulting vapor phase product for cracking is essentially free of metals (e.g., <5 ppmw), even from a feed with up to 100% resid.

Resid as used herein refers to the complex mixture of heavy petroleum compounds otherwise known in the art as residuum or residual. Atmospheric resid is the bottoms product produced in atmospheric distillation when the end-point of the heaviest distilled product is nominally 650° F. (343° C.), and is referred to as 650° F.+ (343° C.+) resid. Vacuum resid is the bottoms product from a column under vacuum when the heaviest distilled product is nominally 1050° F. (566° C.), and is referred to as 1050° F.+ (566° C.+) resid. This 1050° F.+ (566° C.+) portion contains asphaltenes which can result in corrosion and fouling of the apparatus. The term "resid" as used herein means the 650° F.+ (343° C.+) resid and 1050° F.+ (565° C.+) resid unless otherwise specified; note that 650° F.+ (343° C.+) resid comprises 1050° F.+ (565° C.+) resid. According to this invention, at least a portion of the resid having a boiling point within the 650° F.+ (343° C.+) resid up to the 1050° F.+ (565° C.+) boiling point fraction, is vaporized in the knockout drum.

The terms "flash drum", "flash pot", "knockout drum" and knockout pot" are used interchangeably herein; they are per se well-known in the art, meaning generally, a vessel or system to separate a liquid phase from a vapor phase. The term "flash" means generally to precipitate a phase change for at least a portion of the material in the vessel from liquid to vapor, via a reduction in pressure and/or an increase in temperature. The addition of steam may further assist flash separation by reducing the hydrocarbon partial pressure, assist in conversion and vaporization of the 650° F.+ (343°

C.+) to 1050° F.+ (566° C.+) resid fractions, even the 750° F.+ (399° C.+) to 1050° F.+ (566° C.+) (and preferably even a substantial portion of the 1100° F.+ (593° C.+)) resid fractions, and thereby reduce or prevent fouling.

In one preferred embodiment, the material is treated by visbreaking the feed, or portions thereof, and further mild thermal cracking to increase the proportion of vapor phase at the expense of bottoms product. In some of the separation processes, such as in high pressure separators and/or the flash separators, the feed material may be separated into a bottom, substantially liquid phase fraction and an overhead, substantially vapor phase fraction. The vapor fraction may also contain components derived from the resid fraction. The bottoms or liquid phase may include a resid fraction therein. Preferably, both the bottoms fraction and the vapor fraction effluents each contain components derived from the resid fraction, though the composition of the resid fraction of the bottoms effluent will be different from the vapor effluent. Thereby, each of the vapor stream and the bottoms stream may be steam cracked.

The preferred knockout drums or vapor liquid separation devices, and their integration with pyrolysis units have previously been described in U.S. Patent Application Publication Nos. 2004/0004022, 20040004027, and 2004/0004028, and more recently in U.S. application Ser. No. 11/068,615 filed Feb. 28, 2005, Ser. No. 10/851,486 filed May 21, 2004, Ser. No. 10/851,546 filed on May 21, 2004, Ser. No. 10/851,878 filed May 21, 2004, Ser. No. 10/851,494 filed on May 21, 2004, Ser. No. 10/851,487 filed May 21, 2004, Ser. No. 10/851,434 filed May 21, 2004, Ser. No. 10/851,495 filed May 21, 2004, Ser. No. 10/851,730 filed May 21, 2004, Ser. No. 10/851,500 filed May 21, 2004, Ser. No. 11/134,148 filed May 20, 2005, Ser. No. 10/975,703 filed Oct. 28, 2004, Ser. No. 10/891,795 filed Jul. 14, 2004, Ser. No. 10/891,981 filed Jul. 14, 2004, Ser. No. 10/893,716 filed Jul. 16, 2004, Ser. No. 11/009,661 filed Dec. 10, 2004, Ser. No. 11/177,076 filed Jul. 8, 2005; and Ser. No. 11/231,490, filed Sep. 20, 2005. Another preferred apparatus effective as a flash pot for purposes of the present invention is described in U.S. Pat. No. 6,632,351 as a "vapor/liquid separator".

In the process of the present invention, the knockout drum preferably operates at a temperature of between 800° F. (about 425° C.) and 850° F. (about 455° C.), but also typically not over 900° F. (about 482° C.). Passing material through the knockout drum to obtain an overhead vapor and liquid bottoms is referred to herein as "flashing" and may further facilitate substantially complete vaporization of resids boiling up to 650° F. (343° C.) or even up to 750° F. (399° C.), except in some cases for impurities such as the asphaltenes.

Nearly all of a resid-containing hydrocarbon feed can be vaporized, and since the metals and resid are non-volatile, they remain in the liquid phase 7. To be economical, the amount of residual liquid phase should be controlled to be as small as possible, but not so small that the metals precipitate. Roughly 90-98 wt. % of the feed can be vaporized, thus reducing metals concentrations in the vaporized hydrocarbon portion to less than 10 ppm (wt), or even less than 5 ppm (wt), and sent to the catalytic cracking process. The remaining non-vaporized hydrocarbon liquid phase is withdrawn as a bottoms stream 3 from the knockout drum 10.

Vaporizing of the hydrocarbon feed can occur in a heat exchanger 15 upstream of the knockout drum 10, or by a heat source, such as an immersion heater (not shown), in the knockout drum 10. Alternatively, hot steam or light gas can be injected directly into the feed before or in the knockout drum through a high temperature steam inlet pipe 5, which can also vaporize the feed. The temperatures at which the feed is vaporized can be from 800° F. (about 425° C.) to 1000° F. (about 538° C.), even from 850° F. (about 455° C.) to 900° F. (about 482° C.), at pressures from 40 psig (about 276 kPa) to 200 psig (about 1379 kPa). The knockout drum should have a sufficient cross-sectional area to ensure that the vapor disengages from the liquid. This is especially important when the feed is vaporized within the knockout drum.

Advantageously, only one knock out drum is required for an entire catalytic cracking complex; and the knockout drum 10 may be integrated with one or more individual catalytic cracking process reactors 20 for heat integration. The vapor from the knockout drum 10 can be conveyed through an overhead vapor exit pipe 2 directly to a catalytic cracking reactor 20, or can be condensed and stored in tankage.

Upon vaporization of the liquid hydrocarbon feed, at least some of the resid contained in the liquid phase 7 at the bottom of the knockout drum is visbroken (i.e., thermally cracked) into lighter hydrocarbons, which will vaporize at the temperatures in the drum and add to the volume of suitable feed for the catalytic cracker.

The term "hydroprocessing" as used herein is defined to include those processes comprising processing a hydrocarbon feed in the presence of hydrogen to hydrogenate or otherwise cause hydrogen to react with at least a portion of the feed. This includes, but is not limited to, a process comprising the step of heating a resid-containing hydrocarbon feed stream in a hydroprocessing step in the presence of hydrogen, preferably also under pressure. Hydroprocessing may also include but is not limited to the process known as hydrofining, hydroprocessing, hydrodesulfurization (HDS), hydrodenitrogenation (HDN), hydrodeoxygenation (HDO), and hydrocracking.

Figure 2:
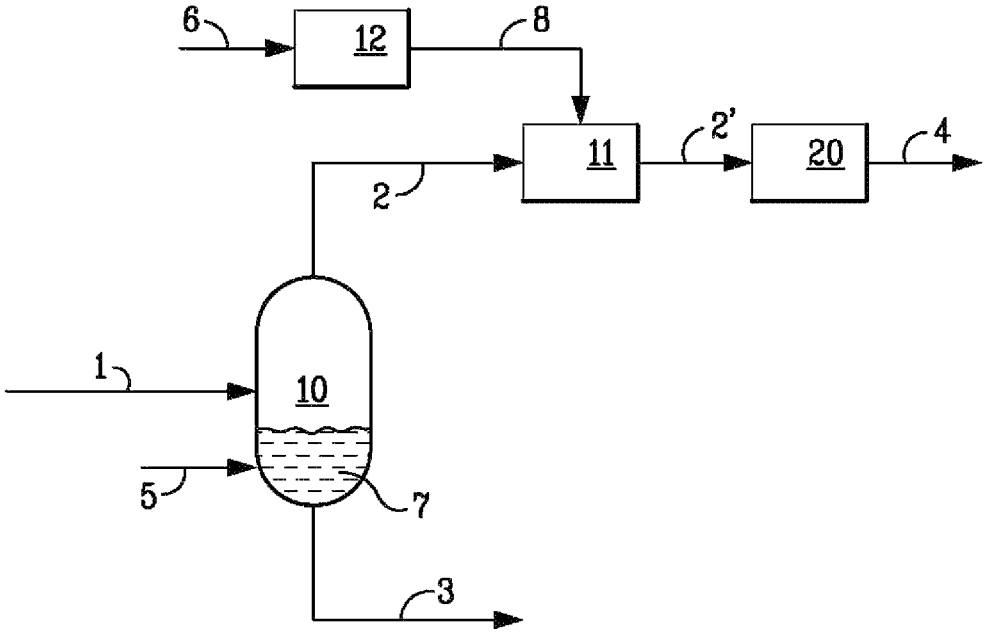
FIG. 2 is an illustration of a system for conducting another embodiment of the invention.

According to the embodiment illustrated in FIG. 2, vaporized hydrocarbons 2 exiting knockout drum 10 can be hydroprocessed in a hydroprocessing unit 11 and the hydroprocessed feed 2' is then fed to catalytic cracking reactor 20, wherein lighter olefins are formed and exit through pipe 4. The hydroprocessing reactor 11 can also be in fluid communication with a steam reformer 12, for converting methane 6 to hydrogen 8 to supply the hydroprocessing unit. Hydrogen 8 can be supplied to the hydroprocessing unit 11 from any convenient source. Upon exiting the catalytic cracking reactor 20, at least a portion of the resid-containing feed 1 has been upgraded to a stream 4 of light ($C_2$-$C_6$) olefins.

In another embodiment of the present invention, it has been found that subjecting a resid-containing hydrocarbon feedstock to hydroprocessing under severe conditions can result in feedstocks particularly suitable for use in catalytic pyrolysis reactors, such as described in U.S. Pat. No. 6,420,621. The catalytic pyrolysis process (CPP) combines thermal and catalytic cracking processes to generate olefin and aromatic products similar to traditional thermal or steam cracking. The CPP reactor is similar to a traditional FCC reactor but is operated at elevated temperatures (more than 150° C. greater than FCC processes) and uses steam as a diluent similar to steam cracking.

However, as noted above, catalytic cracking reactors, including the CPP reactors and catalysts, are particularly sensitive to high levels of metals in the feedstock, since the high temperatures involved in the process tend to vaporize greater amounts of resid, which can result in unwanted deposition of ash (metals) onto the catalyst bed. Accordingly, it would be advantageous to pre-treat resid-containing hydrocarbon feedstocks for such reactors in a manner so as to reduce the content of hydrocarbon resid and greatly reduce or even eliminate naturally occurring metals from the resid-containing feedstock.

Resid hydroprocessing is discussed in U.S. Patent Application Publication No. 2007/0090018, which is incorporated herein by reference in its entirety. Resid hydroprocessing according to the present invention may be carried out at a temperature of at least about 600° F. (315° C.), preferably at least about 650° F. (343° C.), more preferably at least about 750° F. (399° C.). Preferably the pressure is at least 1800 psig. According to some embodiments of the processes of the present invention, hydroprocessing may be performed at a temperature of from about 500° F. (260° C.) to about 900° F. (482° C.), preferably from about 650° F. (343° C.) to 900° F. (482° C.), more preferably from about 700° F. (371° C.) to 90020 F. (482° C.), more preferably from about 750° F. (399° C.) to about 900° F. (482° C.), and still more preferably from about 750° F. (399° C.) to about 800° F. (427° C.). In some embodiments, the preferred pressure is from about 500 to 10,000 psig, preferably 1000 to 4000 psig may be used, and more preferably from about 1500 to 3000 psig. Preferred liquid hourly space velocity may be from about 0.1 to 5, preferably 0.25 to 1. The hydrogen supply rate (makeup and recycle hydrogen) to the hydroconversion zone may be in the range of from about 500 to about 20,000 standard cubic feet per barrel of hydrocarbon feed, preferably about 2,000 to 5,000 standard cubic feet per barrel. The hydroprocessing may be carried out utilizing a single zone or a plurality of hydroprocessing zones, e.g., two or more hydroprocessing zones in parallel or in series. For example, in one embodiment a first zone may comprise a first catalyst that may be designed to accumulate most of the metals removed from the feedstock and a second zone may comprise a second catalyst that can be designed for maximum heteroatom removal and aromatics hydrogenation. In another embodiment, a first catalyst can be designed to accumulate most of the metals removed from the feedstock, a second zone with a second catalyst can be designed for maximum heteroatom removal and a third zone with a third catalyst can be designed to increase aromatics hydrogenation.

According to the present invention, resid hydroprocessing may preferably be carried out at a temperature and pressure that is more severe than conventional hydroprocessing processes are carried out. In one embodiment, the hydroprocessing preferably may be carried out at above 650° F. (343° C.) and up to a temperature that produces substantial hydrocarbon resid cracking during the hydrogenation process, such as about 750° F. (399° C.) to about 800° F. (427° C.). This not only generates a hydrogenated resid component but cracks or breaks down a substantial portion of the resid component into light fractions that, along with injected steam, help with vaporization and thermal processing of the stream in the steam cracker. The light fractions, along with injected steam, help with conversion, cracking and further vaporization and thermal processing of the resid stream within the steam cracker, such as within the cracker piping.

In some embodiments, the means for separating is integrated with the catalytic cracking reactor. Thereby the separation process may be conducted essentially within or within close proximity to the cracking process. In other embodiments, hydroprocessing may be integrated with the catalytic cracking reactor. Thereby, the catalytic cracking reactor may substantially simultaneously hydroprocess the incoming feed, either within the cracking vessel or within close proximity thereto. When resid hydroprocessing is integrated with a cracking reactor the process may be used to produce useful products such as olefins and/or aromatic compounds. Resid hydroprocessing improves olefin yields, reduces metal content and allows resid-containing feedstocks, such as unfractionated crude oil, to be fed directly to the cracking reactor.

Resid hydroprocessing preferably comprises increasing the hydrogen content of the whole crude or crude fraction containing resid, by at least about 1 wt. %, more preferably by 1.5 wt. %, and most preferably to a nearly saturated or fully saturated feed stream effluent from the hydroprocessor. It may be preferred in some embodiments that the effluent from the hydroprocessor has hydrogen content in excess of 12.5 wt. % and more preferably in excess of 13 wt. %. Increasing the hydrogen content of the whole crudes, crude fractions, or other feed stocks may serve to render the hydrogenated product thereof suitable for feeding to a pyrolysis unit for cracking, thereby generating more valuable end products, such as olefins. Thereby, lower cost catalytic pyrolysis reactor feeds may be used for the production of olefins. Suitable lower value feeds may typically include heavier crudes, those hydrocarbon feedstocks that have high concentrations of resid, high sulfur, high TAN, high aromatics, and/or low hydrogen content. Hydrogenation of the crude or crude fraction and removal of contaminants may facilitate feeding such effluent, including the vaporized resid fraction, e.g., the 1050° F. (565° C.) and lower fractions, or the 1100° F. (593° C.) and lower fractional components, and even some of the 1400° F. (760° C.) and lower boiling point fractions directly to a catalytic cracking reactor for production of valuable petrochemical products, such as olefins, without undesirable fouling and without resulting in the undesirable production of tar and coke.

In other aspects, the invention includes a process for forming light olefins, comprising: (a) hydroprocessing a liquid hydrocarbon feedstock containing at least about 10 ppmw metals to form a hydroprocessed feedstock; (b) separating the hydroprocessed feedstock using a tar knockout drum into (i) a hydrocarbon vapor effluent having less than about 10 ppmw metals, the vaporized portion comprising at least 90 wt. % of the hydroprocessed feedstock, and (ii) a non-vaporized resid-containing portion of the feedstock; and (c) feeding the hydrocarbon vapor effluent to a catalytic cracking process to form light olefins.

In other embodiments, the process further comprising visbreaking at least a portion of the resid-containing hydrocarbon feedstock prior to feeding at least a portion of the visbroken feedstock to the catalytic cracking process.

In still other embodiments, the process further comprises further hydroprocessing at least a portion of the non-vaporized resid-containing portion of the feedstock.

According to other aspects, the invention includes a catalytic cracking system for forming light olefins, comprising: (a) means for heating a liquid hydrocarbon feedstream comprising at least 10 ppmw metal to vaporize at least 90 wt. % of the feedstream; (b) a knockout drum for separating a vaporized hydrocarbon portion having less than 10 ppmw metal and a liquid hydrocarbon portion; and (c) a catalytic cracking reactor in fluid communication with the knockout drum for cracking at least a portion of the vaporized portion.

In other embodiments, the knockout drum has a hydrocarbon feed inlet, an overhead vapor outlet, and a bottoms liquid outlet, and wherein the catalytic cracking reactor is in fluid communication with the overhead vapor outlet.

In some embodiments of the system, the catalytic cracking reactor comprises at least one of a catalytic pyrolysis process reactor, a fluidized catalytic cracking reactor, a high severity fluidized catalytic cracking reactor, and a deep catalytic cracking reactor.

In other system embodiments, the means for heating comprises a steam inlet on the knockout drum.

According to other embodiments, the means for heating includes an immersion heater within the knockout drum.

In yet other embodiments, the means for heating includes at least one of a furnace convection section and an indirect heat exchanger disposed upstream of the knockout drum.

In other embodiments, the system may further comprise a hydroprocessing unit disposed upstream of the catalytic cracking reactor.

In other embodiments, the means for separating is integrated with the catalytic cracking reactor.

In other aspects, the invention includes an apparatus for cracking resid-containing hydrocarbon feedstocks, comprising a heat source, a knockout drum, and a catalytic pyrolysis reactor for cracking a vaporized fraction of the hydrocarbon feed from the knockout drum in the catalytic pyrolysis reactor.

In another embodiment, the apparatus further comprises a hydroprocessing unit disposed upstream of the catalytic pyrolysis reactor.

In other embodiments, the heat source includes at least one of an indirect heat exchanger, a furnace convection section, an immersion heater and a steam inlet pipe on the knockout drum.

In other embodiments, the inventive process includes heating the resid-containing hydrocarbon feedstock in the knockout drum, such as by using a in internal heat source, such as an immersion heating element or immersed heated coil or heat exchanger coil, or via introduction of steam or other hot gas or material into the drum, preferably into the fluid holding portion of the drum.

In another embodiment, the heat source is disposed upstream of the knockout drum and the heat source includes at least one of a furnace convection section, an indirect heat exchanger, and combinations thereof.

In some embodiments, the knockout drum separates at least 90 wt. % of the hydrocarbon feedstock entering the knockout drum into an overhead vaporized portion of the feedstock and vaporized portion is fed to the catalytic pyrolysis reactor.

In other embodiments of the inventive processes and/or apparatus reduce the metals content to less than 5 ppmw in the vaporized cut.

In another embodiment, the process and/or apparatus further comprise visbreaking the resid.

In another aspect of the inventive process, the heat source is provided within or internal to the knockout drum, and may include, for example, inlets such that steam and/or hot gas may be provided within the knockout drum to provide the heat. In other embodiments, the heat source within the knockout drum may be provided by an immersion heater therein, and optionally steam and/or a gas stream may also be provided within the drum.

In another embodiment, the catalytic cracking process is selected from the group consisting of a catalytic pyrolysis process, a fluidized catalytic cracking process, a high severity fluidized catalytic cracking process and a deep catalytic cracking process, and is often preferably a catalytic pyrolysis process.

In other embodiments, the resid-containing hydrocarbon feedstock contains at least 100 ppmw metals or even at least 200 ppmw metals.

In one embodiment, the feedstock for the process can comprise at least 10 wt. %, or at least 50 wt. %, or even at least 90 wt. % of an unfractionated crude oil.

In some embodiments, at least 10 wt. % and preferably at least 50 wt. % of the hydrocarbon feedstock may include at least one of an unfractionated crude, atmospheric distillation bottoms, vacuum distillation bottoms, post-cracking resid streams, other resid streams, metal contaminated hydrocarbon streams, whole crude streams, distressed or contaminated gas-oil streams, virgin crude, asphaltene-laden streams, tar-laden streams, a hydrocarbon feed including fractions having a final boiling point in excess of 343° C. and a metals content of at least 10 ppmw, and mixtures thereof.

In other aspects, the inventions may also include:

1. A process for forming light olefins, comprising:

(a) heating a hydrocarbon feedstock containing at least 10 ppmw of metals sufficiently to vaporize at least 90 wt. % of the hydrocarbon feedstock;

(b) separating in a knockout drum a hydrocarbon vapor portion having less than 10 ppmw metals from a non-vaporized resid-containing portion; and (c) feeding the hydrocarbon vapor to a catalytic cracking process to form light olefins.

2. The process of claim 1, further comprising heating the resid-containing hydrocarbon feedstock in an indirect heat exchanger and feeding a heated resid-containing hydrocarbon feedstock to the knockout drum.
3. The process according to paragraph 1 or 2, further comprising heating the resid-containing hydrocarbon feedstock in the knockout drum.
4. The process of according to any preceding paragraph, further comprising heating the knockout drum internally with at least one of an immersion heater, introduction into the drum of steam, and introduction into the drum of a heated gas, and combinations thereof.
5. The process of paragraph 1, further comprising visbreaking the hydrocarbon feed upstream of the knockout drum.
6. The process of paragraph 1, further comprising heating the hydrocarbon stream using at least one of indirect heat exchange, convection heating, steam, hot gas, an immersion heater within the knockout drum, and combinations thereof.
7. The process of paragraph 1, wherein the catalytic cracking process is selected from the group consisting of a catalytic pyrolysis process, a fluidized catalytic cracking process, a high severity fluidized catalytic cracking process, and a deep catalytic cracking process.
8. A catalytic cracking system for forming light olefins using a process according to any of the preceding paragraphs, the system comprising:

(a) means for heating a liquid hydrocarbon feedstream comprising at least 10 ppmw metal to vaporize at least 90 wt. % of the feedstream;

(b) a knockout drum for separating a vaporized hydrocarbon portion having less than 10 ppmw metal and a liquid hydrocarbon portion; and (c) a catalytic cracking reactor in fluid communication with the knockout drum for cracking at least a portion of the vaporized portion.

9. The catalytic cracking system of paragraph 8, wherein the knockout drum has a hydrocarbon feed inlet, an overhead vapor outlet, and a bottoms liquid outlet, and wherein the catalytic cracking reactor is in fluid communication with the overhead vapor outlet.
10. The catalytic cracking system of paragraph 8, wherein the catalytic cracking reactor comprises at least one of a catalytic pyrolysis process reactor, a fluidized catalytic cracking reactor, a high severity fluidized catalytic cracking reactor, and a deep catalytic cracking reactor.

11. The catalytic cracking system of paragraph 8, wherein the means for heating comprises at least one of a steam inlet on the knockout drum, a hot gas inlet on the knockout drum, an indirect heat exchanger disposed upstream of the knockout drum, a steam cracking furnace convection section, and an immersion heater within the knockout drum.

12. The catalytic cracking system according to any of the preceding paragraphs, further comprising a hydroprocessing unit disposed upstream of the catalytic cracking reactor.

13. The catalytic cracking system of paragraph 12, wherein the knockout drum is integrated with the catalytic cracking reactor.

14. The process, apparatus, or system according to any of the preceding paragraphs, wherein the knockout drum separates at least 90 wt. % of the hydrocarbon feedstock entering the knockout drum into an overhead vaporized portion, wherein the vaporized portion is fed to the catalytic pyrolysis reactor.

15. The process, apparatus, or system according to any of the preceding paragraphs, wherein the hydrocarbon feedstock includes at least a portion of a hydrocarbon feed comprising at least one of unfractionated crude, atmospheric distillation bottoms, vacuum distillation bottoms, post-cracking resid streams, other resid streams, metal contaminated hydrocarbon streams, whole crude streams, distressed or contaminated gas-oil streams, virgin crude, asphaltene-laden streams, tar-laden streams, hydrocarbon streams including fractions having a final boiling point in excess of 343° C. and a metals content of at least 10 ppmw, and mixtures thereof.

While the present invention has been described and illustrated by reference to particular embodiments, those of ordinary skill in the art will appreciate that the invention lends itself to variations not necessarily illustrated herein. For this reason, then, reference should be made primarily to the appended claims for purposes of determining the true scope of the present invention.

What is claimed is:

1. A process for forming light olefins, comprising:

(a) heating a hydrocarbon feedstock containing at least 10 ppmw of metals and at least 5.0 wt % asphaltenes at a temperature range of from 870° F. to 1000° F. to produce a vaporized hydrocarbon by visbreaking said hydrocarbon feedstock and vaporizing at least 98 wt. % of said hydrocarbon feedstock;

(b) separating the vaporized hydrocarbon in a knockout drum to produce a hydrocarbon vapor portion having less than 10 ppmw metals and a non-vaporized resid-containing portion, wherein (i) said visbreaking of step (a) is carried out upstream of the knockout drum, (ii) steps (a) and (b) are carried out upstream of any hydroprocessing of said hydrocarbon feedstock, (iii) additional visbreaking is carried out in the knockout drum, and (iv) said hydrocarbon vapor portion has less than 5 ppmw of metals; and (c) feeding said hydrocarbon vapor portion to a catalytic cracking process to form light olefins.

2. The process of claim 1, further comprising heating said non-vaporized resid-containing portion in an indirect heat exchanger to produce a heated resid-containing hydrocarbon feedstock and feeding the heated resid-containing hydrocarbon feedstock to said knockout drum.

3. The process of claim 1, further comprising heating said non-vaporized resid-containing portion in said knockout drum.

4. The process of claim 1, further comprising heating said knockout drum internally with at least one of an immersion heater, introduction into said knockout drum of steam, and introduction into said knockout drum of a heated gas, and combinations thereof.

5. The process of claim 1, further comprising heating said hydrocarbon feedstock using at least one of indirect heat exchange, convection heating, steam, hot gas, an immersion heater within said knockout drum, and combinations thereof.

6. The process of claim 1, wherein said catalytic cracking process is selected from the group consisting of a catalytic pyrolysis process, a fluidized catalytic cracking process, a high severity fluidized catalytic cracking process, and a deep catalytic cracking process.

7. The process of claim 1, wherein said non-vaporized resid-containing portion comprises unfractionated crude.

8. A process for forming light olefins, comprising:

(a) hydrodemetallizing a liquid hydrocarbon feedstock containing at least about 10 ppmw metals to form a hydrodemetallized feedstock;

(b) visbreaking said hydrodemetallized feedstock in a tar knockout drum to produce a visbroken hydrodemetallized feedstock and separating said visbroken hydrodemetallized feedstock in the tar knockout drum into (i) a hydrocarbon vapor effluent having less than about 5 ppmw metals, said hydrocarbon vapor effluent comprises at least 98 wt. % of said hydrodemetallized feedstock, and (ii) a non-vaporized resid-containing portion, said hydrodemetallized feedstock's metals remaining in said non-vaporized resid-containing portion; and (c) feeding said hydrocarbon vapor effluent to a catalytic cracking process to form light olefins.

9. The process of claim 8, further comprising visbreaking at least a portion of said hydrodemetallized feedstock at a location upstream of the tar knockout drum.

10. The process of claim 8, further comprising further hydroprocessing at least a portion of said non-vaporized resid-containing portion.

11. The process of claim 8, wherein said catalytic cracking process comprises a catalytic pyrolysis process.

* * * * *